350-397 SR
10/27/87 XR 4,703,229

United States Patent [19]
Nighan et al.

[11] Patent Number: 4,703,229
[45] Date of Patent: Oct. 27, 1987

[54] OPTICAL DISPLAY FROM XEF EXCIMER FLUORESCENCE

[75] Inventors: William L. Nighan, Manchester; Fred A. Otter, Jr., Columbia, both of Conn.

[73] Assignee: United Technologies Corporation, Hartford, Conn.

[21] Appl. No.: 786,258

[22] Filed: Oct. 10, 1985

[51] Int. Cl.[4] ..... G09G 3/10
[52] U.S. Cl. ..... 315/169.4; 313/582; 350/397; 350/408; 358/61
[58] Field of Search ..... 358/61; 315/169.4; 350/408, 397; 313/582, 584, 586, 587

[56] References Cited

U.S. PATENT DOCUMENTS

| | | | |
|---|---|---|---|
| 3,263,113 | 7/1966 | Schroder | 313/579 |
| 3,311,777 | 3/1967 | Schroder | 313/579 |
| 3,383,460 | 5/1968 | Pritchard | 358/61 |
| 4,013,912 | 3/1977 | Hinson | 313/226 |
| 4,549,109 | 10/1985 | Nighan et al. | 315/169.4 |
| 4,582,396 | 4/1986 | Bos et al. | 358/61 |

OTHER PUBLICATIONS

C. M. Ferrar and W. L. Nighan, "Excimer Fluorescence for Display Applications", *IEEE Transactions on Electron Devices,* vol. ED-30, No. 5, May 1983, pp. 439-443.

W. L. Nighan and C. M. Ferrar, "Excimer Fluorescence for Plasma Displays", *Applied Physics Letters,* vol. 40, No. 3, Feb. 1, 1982, pp. 223-224.

O. Sahni and C. Lanza, "Origin of the Bistable Voltage Margin in the AC Plasma Display", *IEEE Transactions on Electron Devices,* vol. ED-24, No. 7, Jul. 1977, pp. 853-858.

W. L. Nighan, "Basic Kinetic Processes in Neon Gas Discharge Displays", *IEEE Transactions on Electron Devices,* vol. ED-28, No. 6, Jun. 1981, pp. 625-630.

Y. C. Yu, D. W. Setser, and H. Horlguchi, "Thermochemical and Kinetic Studies of the Xenon Halide B and C States in 0.5-5 atm of Buffer Gas", *The Journal of Physical Chemistry,* vol. 87, No. 12, 1983, pp. 2199-2209.

R. Sauerbrey, W. Walter, F. K. Tittel and W. L. Wilson, Jr., "Kinetic Processes of Electron Beam Generated XeF* and $XE_2F$* Excimers", *The Journal of Chemical Physics,* vol. 78, No. 2, Jan. 15, 1983, pp. 735-747.

J. J. McCormick, "Liquid-Crystal Shutter Adds Low--Cost Color to Monochrome CRTs", *Electronic Design,* Mar. 7, 1985, pp. 177-184.

A. Wilson, "Liquid Crystal Switch Enhances Color in Field Sequential Displays", *Electronic Imaging,* Aug. 1983, pp. 45-46.

"LC+CRT=Color Display", *Electro-Optics,* p. 10.

*Primary Examiner*—Harold Dixon

[57] ABSTRACT

An excimer optical display includes a plasma panel device having therein a mixture of gas comprising xenon and molecular fluorine and a selected amount of other gases forming XeF excimer molecules such that the color of fluorescence is adjustable over a broad spectrum by selection of the gas mixture constituents.

11 Claims, 7 Drawing Figures

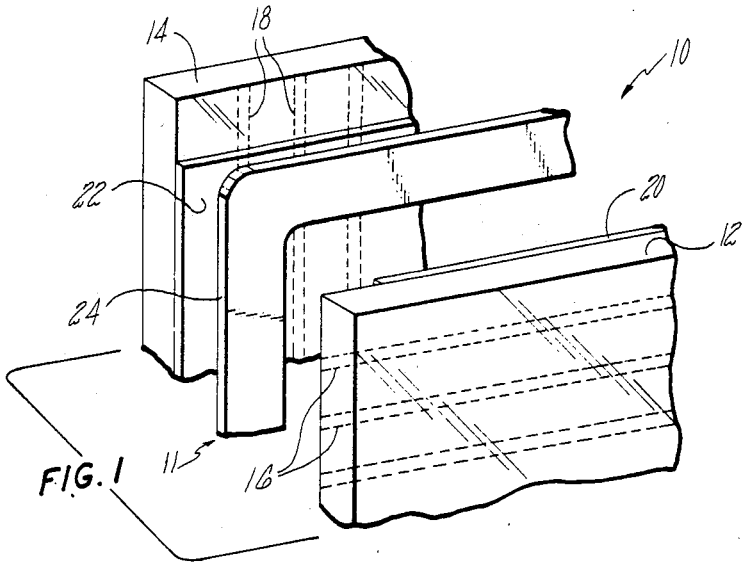
FIG. 1
FIG. 2
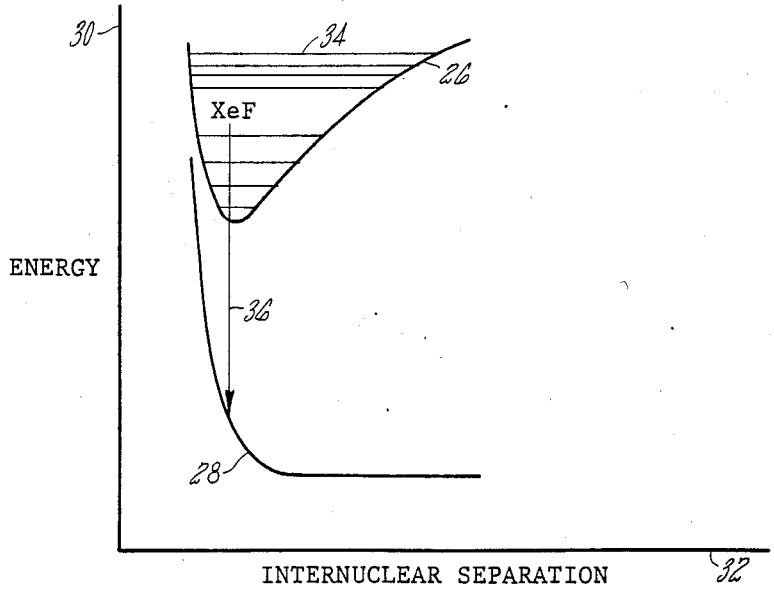

OPTICAL DISPLAY FROM XEF EXCIMER FLUORESCENCE

The Government has rights in this invention pursuant to Contract No. DAAG-29-83-C-0013 awarded by the Department of the Army.

TECHNICAL FIELD

This invention relates to visible electronic display devices and more particularly to optical display devices using XeF excimer fluorescence.

BACKGROUND ART

A display is an electronic component or subsystem used to convert electrical signals into visual imagery suitable for direct interpretation by a human observer. In the field of display devices those employing the gaseous glow discharge phenomenon are used in many applications. The terms gas discharge display and plasma display and plasma panel are each used to describe displays of this type. Because of a uniquely favorable combination of electrical and optical properties, the neon gas discharge is the one invariably used for plasma display purposes. Although all electric discharges result in the generation of visible light, only Ne-based gas mixtures are capable of producing visible radiation having brightness and efficiency that are suitable for display applications; these displays are always orange in color. Since other rare gas mixtures do not have the luminous efficiency of neon, to achieve an acceptable visible brightness level so that other gases can be used the gas discharge must be driven at more than ten times the drive current or duty cycle, a factor that severely restricts their use for practical application.

Rare gas mixtures are used for other purposes in the display art, however. In U.S. Pat. No. 4,013,912 of D. C. Hinson, a gas discharge mixture comprised essentially of argon and xenon in approximately equal proportions is disclosed. Although such a mixture produces no visible emission of practical use, reactions in the gas discharge result in the formation of excited molecular states of argon and xenon which decay producing radiation in the vacuum ultraviolet region. The ultraviolet radiation excites color phosphors which are incorporated in the display and which subsequently produce visible emission after bombardment by the UV photons. Incorporation of the phosphor in display devices has proven to be difficult and costly, however, and problems with display resolution and phosphor lifetime are significant. For these reasons hybrid plasma displays of the gas discharge/phosphor type as disclosed in the Hinson patent are still in a developmental stage and offer little promise as a replacement for neon based displays for applications where the latter can be used.

Another approach employs a mercury-based argon mixture developed by O. Sahni and reported in a paper in the 1980 SID International Symposium Digest of Technical Papers, April 1980. Using this mixture blue emission was obtained from an AC plasma panel with a luminous efficiency and brightness comparable to that of Ne-based displays. However, the strong temperature dependence of the mercury vapor pressure results in electrical and optical characteristics that are very sensitive to temperature, and mercury cannot be used in certain applications for safety reasons, factors that practically preclude the use of the mercury-argon mixture for displays.

In articles published in Applied Physics Letters 40, 223 (1982) and in the IEEE Transactions on Electron Devices ED-30, 439 (1983) W. L. Nighan and C. M. Ferrar reported on the feasibility of utilizing visible fluorescence from excimer molecules for plasma displays. The term excimer is used widely in the laser art in reference to excited molecular species which are not stable in the ground electronic state. Excimer molecules are semistable and do not exist in the absence of the discharge. Rather, excimer molecules are generated by the action of the discharge on the initial gas mixture constituents and then produce visible radiation upon dissociation.

The prior art also contains a commonly owned U.S. patent application, Ser. No. 625,199, filed June 28, 1984, a continuation of U.S. Ser. No. 322,098, filed Nov. 16, 1981 of W. L. Nighan, et al, entitled "Optical Display With Excimer Fluorescence".

Disclosed in the application is a plasma display using visible excimer molecule fluorescence of a heteronuclear excimer such as $Xe_2Cl$, XeO and XeF. Using an AC plasma panel, monochrome emission in the blue/-green region of the spectrum was obtained using gas mixtures in which either $Xe_2Cl$ or XeO was produced. However, XeF is unique among the rare gas monohalide excimer molecules in that it alone exhibits both ultraviolet and visible transitions, the existence of the former interfering severely with the generation of visible radiation. Additionally, XeF is the only rare gas monohalide excimer that is destroyed by collisions with both the rare gas atom from which it is made, xenon, and by the source of fluorine from which it is produced, $F_2$, factors that severely restrict conditions under which XeF can be formed.

Although the visible transition of XeF has been demonstrated in the laser art, the pumping energy densities used for lasers are several orders of magnitude larger than those permissible for display applications and the gas pressures used are several times larger than atmospheric, an intolerable condition for display technology. For these reasons means to utilize visible XeF excimer molecule fluorescence are unknown in the prior display art.

Although plasma displays deriving their visible emission from the fluorescence of neon gas are far superior to those using any other prior art gas mixture, neon-based displays can only produce an orange color, which is not acceptable for some applications, and their brightness is insufficient under conditions of high ambient light. Since changing the gas mixture is, in principle, the easiest way to change the color of a gas discharge display, efforts to develop a practical alternative to the Ne-based plasma display mixture have been proceeding on many fronts for well over ten years, but no suitable alternative has been found. An article by L. F. Weber appearing in the book Flat Panel Displays (L. E. Tannas, editor), Van Nostrand and Reinhold, New York 1985 provides a comprehensive review of the state of plasma information display science and technology up to the present time.

DISCLOSURE OF INVENTION

An object of the present invention is to provide an optical display from XeF excimer fluorescence. Another object of the present invention is to provide a full color XeF excimer optical display. Still another object of the present invention is to provide an AC XeF excimer optical plasma panel display having a large voltage margin.

According to the present invention, an excimer optical display includes an enclosure that has an internal cavity with opposing major surfaces, the enclosure having an optically transmissive portion. Contained within the interior cavity is a gas mixture comprised of xenon, fluorine and a rare gas. Also included is an electrode array that is responsive to external command signals. The electrode array is fabricated on at least one of the opposing major surfaces of the interior cavity to form a plurality of discharge sites. In response to the external command signal the electrode array provides a gas discharge at the discharge sites so that XeF excimer molecules are formed in an excited state and emit visible radiation upon decay therefrom.

According to another aspect of the present invention, a full color XeF excimer optical display includes an enclosure that has an optically transmissive portion and that has an interior cavity with opposing major surfaces. Gas mixtures are contained within the cavity and comprise xenon, fluorine, and a rare gas. An electrode array is fabricated on at least one of the opposing major surfaces of the interior cavity, the electrodes being responsive to synchronization signals provided thereto. In response to the external synchronization signals, the electrode array provides a gas discharge at the discharge sites so that XeF excimer molecules are formed in an excited state, emitting visible radiation upon decay therefrom comprised substantially of two primary colors. Also included are optical filters that are responsive to the synchronization signals. The optical filters receive and divide the visible radiation into each of the two primary colors and subsequently provide selective recombination thereof in response to the synchronization signals so as to produce any color that can be produced from the primary colors. The full color XeF excimer optical display also comprises an electronic signal processor that is responsive to external command signals. The electronic signal processor provides the synchronization signals to the electrode array and the optical filters.

According to yet another aspect of the present invention, an AC XeF excimer optical plasma panel display includes an enclosure fabricated of fluorine compatible materials that has an optically transmissive portion. The enclosure also has an interior cavity with opposing major surfaces. A gas mixture is contained within the interior cavity and is comprised of xenon, fluorine and a rare gas. An electrode array is also included and is responsive to external AC command signals. The electrode array is fabricated on at least one of the opposing major surfaces forming therebetween a plurality of discharge sites. The electrode array means provides a gas discharge having a voltage margin at said discharge sites in response to said external AC command signals such that xenon fluoride excimer molecules are formed in an excited state, emitting visible radiation upon decay therefrom.

BRIEF DESCRIPTION OF DRAWINGS

FIG. 1 is an exploded illustration of a portion of a XeF excimer optical display provided according to the present invention;

FIG. 2 is a drawing showing the potential energy curves of the radiating XeF(C) excimer state and terminal XeF(A) repulsive state;

BEST MODE FOR CARRYING OUT THE INVENTION

Figure 3A:
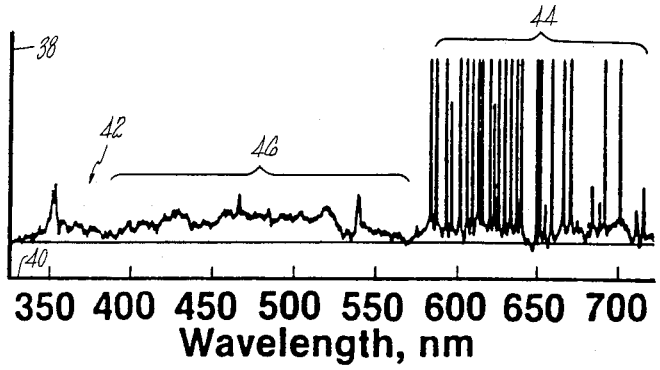
FIG. 3A represents mixture of Ne-Xe-$F_2$XeF(c) while FIG. 3B adds argon and FIG. 3C adds krypton.

Referring first to FIG. 1, in an exploded view of a portion of an optical display from XeF excimer fluorescence provided according to the present invention, an XeF excimer optical display 10 including enclosure 11 formed from glass plates 12 and 14. In the best mode embodiment substantially perpendicular electrode arrays 16 and 18 are formed on glass plates 12 and 14 respectively. The electrode arrays are isolated from a gas mixture contained therein (not shown) by dielectric sheets 20 and 22 fabricated in the best mode embodiment from a 0.010–0.050 millimeter glass dielectric of a type known in the art such as quartz coated with an approximately 200 nanometer thick protective inner electron emitting layer such as magnesium fluoride or equivalent that is nonreactive in the presence of fluorine gas. The two dielectric sheets are separated by approximately 0.1 millimeters by a spacer sealer 24. When assembled the gas mixture occupies the space therebetween. The intersections of the electrode array define individual discharge sites in the space therebetween.

Although the best mode embodiment has been disclosed hereinabove, those skilled in the art will note that equivalent fluorine compatible materials and/or fabrication techniques may be substituted in the enclosure. Moreover, other electrode array geometries, such as an array fabricated on one glass plate separated by a dielectric layer, may be equivalently substituted.

To display information external command signals comprising voltage pulses of controllable amplitude and variable repetition rate are selectively applied to the exposed ends of individual electrodes by conventional electrical apparatus not shown and not part of the present invention. As is well known in the art, capacitive coupling through the glass and electron emitting inner coatings produces a plasma discharge within the gas at the particular discharge site(s) energized.

In the best mode embodiment, the plasma panel apparatus is filled with a gas mixture comprised of neon at a partial pressure of approximately 500 Torr, xenon at a partial pressure of approximately 5 Torr and a molecular fluorine gas, $F_2$, at a pressure of approximately 1 Torr.

Referring now to FIG. 2, there is shown a drawing illustrating the potential energy curves 26 and 28 of a radiating XeF(C) excimer state and terminal XeF(A) repulsive state, respectively. Axes 30 and 32 correspond to energy and internuclear separation, respectively. Under the influence of an electric discharge the XeF excimer molecule is produced in such a mixture by means of the following reaction sequence:

$$e + Xe \rightarrow Xe^* + e$$
$$\rightarrow Xe^+ + 2e$$

-continued $$Ne^* + Xe \rightarrow Xe^* + Ne$$
$$\rightarrow Xe^+ + e + Ne$$
$$Xe^* + F_2 \rightarrow XeF + F$$
$$Xe^+ + F^- + Ne \rightarrow XeF + Ne$$

As a consequence of such a reaction sequence, XeF excimer molecules are produced in very high vibrational levels of the B and C electronic states of which level 34 is an example; and where the letters B and C are conventional references to particular states of the excimer usually expressed as XeF(B) and XeF(C).

Collisions between gas molecules and XeF(B) excimer states convert B states to XeF(C) states such that the preponderance of XeF excimers are in the C state (curve 26). Radiative dissociation of the XeF(C) excimer state then occurs producing visible electromagnetic radiation by the reaction:

$$XeF(C) \rightarrow XeF(A) + h\nu$$

as indicated by line 36 and where curve 28 corresponds to the terminal XeF(A) repulsive state.

Visible emission, bright pink in color, is observed when the Ne-Xe-$F_2$ gas mixture is excited by pulses approximately 250 volts in magnitude at a repetition frequency that was varied over the range 10 kHz–200 kHz. The total brightness level measured with a CIE filtered photometer having a response similar to that of the human eye is higher than ever observed for any room temperature gaseous mixture excited at the same repetition rate, including conventional Ne-based "Penning" mixtures currently used in prior art plasma panel displays.

FIG. 3 contains illustrations of the wavelength dependence on gas mixture for the excimer optical display of FIG. 1.

FIG. 3*a* presents the measured wavelength dependence of fluorescent emission over the 350 to 700 nanometer wavelength range for a Ne-Xe-$F_2$XeF(C) mixture used in the excimer display of FIG. 1. Axes 38 and 40 correspond to emission intensity and wavelength respectively with curve 42 corresponding to the fluorescent emission spectra thereof. Axis 40 spans wavelengths substantially between 325 and 725 nm. The gas mixture comprises approximately 5 Torr xenon, approximately 1 Torr fluorine and approximately 500 Torr of neon.

Region 44 (between 580 nm and 700 nm) corresponds to radiation from Ne transitions, indicating that the well known Ne line radiation is present. Additionally, for wavelengths between 400 nm and 600 nm very broadband continuous radiation (region 46) from the XeF C→A excimer transition is clearly apparent. Since for these specific conditions, the XeF excimer emission covers almost the entire visible range, if viewed alone it would appear nearly white in color. When combined with the Ne line transitions occurring at the red end of the spectrum the eye perceives the combination as pink.

Measurements of the total brightness of the Ne (500 Torr) - Xe (5 Torr) - $F_2$ (1 Torr) mixture indicated that the brightness was twice as high as that of an orange Ne Penning mixture operating under similar conditions. The presence of 5 Torr Xe and 1 Torr $F_2$ has little or no adverse quenching effect on the conventional red Ne transitions, but the additional Xe and $F_2$ generate very broadband white XeF C→A emission that adds to the Ne emission, producing a nearly 100% increase in total brightness and a pink color. Moreover, a similar fluorescent spectrum can be obtained with Xe partial pressures in the 2–10 Torr range and $F_2$ partial pressures in the 0.5–2.0 Torr range, the range of Xe and $F_2$ partial pressures having been determined to provide an optimum balance between the heretofore described XeF formation sequence and the collisional destruction of XeF.

The natural lifetime of the XeF(C) excimer prior to radiative decay is well known to be 100 nsec, and the rate coefficient for vibrational relaxation, $k_V$ of the XeF(C) molecule by Ne is estimated in the chemical physics art to be approximately $1\times10^{-12}$ $sec^{-1}$ $cm^3$. The time characterizing vibrational relaxation, $T_V$ is related to the particle concentration density of the mixture, N, by the expression:

$$T_V = (Nk_V)^{-1}.$$

For a Ne pressure of 500 Torr used in the Ne-Xe-$F_2$ mixture of FIG. 3*a* the concentration N is about $1.6\times10^{19}$ particles/$cm^3$. Thus, TV for the gas mixture of FIG. 3*a* is determined from the relation above to be about 60 nsec, a value that is nearly the same as the radiative lifetime of the XeF(C) excimer molecules. This fact is very important for it means that XeF (C→A) radiation and vibrational relaxation occur simultaneously with neither process dominating. Because a large number of XeF(C) vibrational levels having different initial energies participate in the radiative process, and because of the unique variation with internuclear separation of the XeF(A) potential energy (curve 28 FIG. 2), the resulting XeF (C→A) emission wavelengths extend from 400 nm to 600 nm for the inventors Ne-Xe-$F_2$ mixture, spanning the entire visible range and producing the emission spectrum shown in FIG. 3*a* which is perceived by the eye as white light.

The fact that XeF(C) vibrational relaxation is relatively slow when Ne is the dominant mixture constituent, as evidenced by the fact that the vibrational relaxation time is comparable to the 100 nsec radiative lifetime of XeF(C), implies that for the pink display conditions of FIG. 3*a* the XeF(C) molecules are characterized by a very high vibrational temperature.

Other rare gases including argon and krypton are known in the chemical physics art to be much more effective than Ne at relaxing XeF(C) vibrational states, i.e. more efficient at lowering the vibrational temperature of XeF(C). In order to change the relationship between the XeF(C) vibrational relaxation time and the radiative lifetime, Ar is added to the Ne-Xe-$F_2$ gas mixture.

Figure 3B:
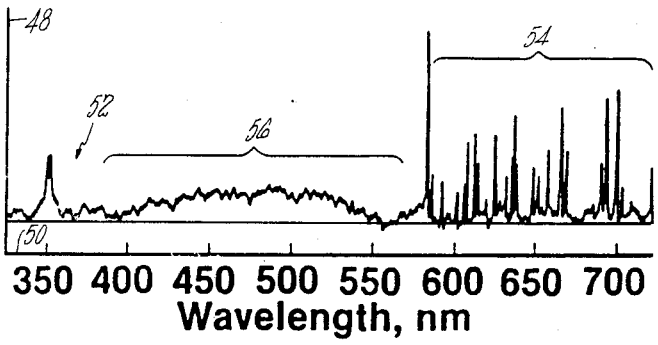
FIG. 3 is an illustration of the wavelength and gas mixture dependence of the excimer optical display of FIG. 1.

FIG. 3*b* illustrates the wavelength dependence of fluorescent emission from a Ne-Xe-$F_2$-Ar XeF(C) excimer mixture comprised of 470 Torr Ne, 5 Torr Xe, 1 Torr $F_2$ and 50 Torr Ar. Axes 48 and 50 correspond to emission intensity and wavelength respectively. Curve 52 corresponds to the fluorescent spectra thereof. Argon has a rate coefficient for vibrational relaxation of XeF(C) that is about ten times larger than that of Ne. Therefore addition of only 50 Torr of Ar to the mixture reduced the time required for XeF(C) vibrational relaxation by about 50% to a value about one-fourth that of the XeF(C) radiative lifetime. When the excimer optical display of FIG. 1 comprises the gas mixture of FIG. 3*b* the color changes from pink to nearly white with a slight tint of either pink or blue depending on specific circumstances. With Ar in the mixture, red Ne line radiation (region 54) is significantly reduced in intensity and the XeF (C→A) radiation exhibits a broad maximum (region 56) centered at a wavelength of about 475 nm. For the mixture of FIG. 3*b* the total brightness of the emission was found to be about the same as that of a conventional Ne Penning mixture. Moreover, brightness of this magnitude is typical of mixtures containing 20–100 Torr Ar partial pressures, 2–10 Torr Xe partial pressures and 0.5–2.0 Torr $F_2$ partial pressures.

Figure 3C:
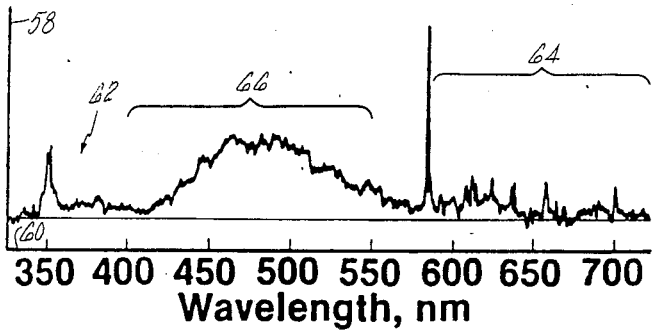

To further reduce the time typical of XeF(C) vibrational relaxation, and therefore the XeF(C) vibrational temperature, Kr is added to the Ne-Xe-$F_2$ mixture, as illustrated in FIG. 3*c*, such that the gas mixture comprises 400 Torr of Ne, 5 Torr of Xe, 1 Torr of $F_2$ and 100 Torr of Kr. Axes 58 and 60 again correspond to energy and wavelength, respectively, and curve 62 is the fluorescent spectra thereof. Krypton has a rate coefficient for vibrational relaxation of XeF(C) that is about ten times larger than that of Ar and one hundred times larger than that of Ne. Therefore addition of 100 Torr Kr to the mixture results in conditions such that vibrational relaxation to the very lowest XeF(C) vibrational levels occurs in such a short time compared to the natural lifetime of XeF(C) that radiation from the C to the A state of XeF is typical of a room temperature vibrational distribution. The color of the emission of the gas mixture of FIG. 3*c* is deep blue at a brightness level comparable to that of a Ne Penning mixture. Curve 62 reveals that with Kr in the mixture the Ne red lines are suppressed almost entirely (region 64), and the XeF (C→A) emission is strongly peaked at 475 nm (region 66), a wavelength that appears blue to the eye. Similar results were obtained for Kr partial pressures in the 50 Torr–200 Torr range, 2–10 Torr Xe partial pressures and 0.5–1.0 Torr $F_2$ partial pressures. In addition, similar spectra are obtained using Ar and Kr in various combinations with and without Ne and with and without He at a total mixture pressure substantially in the 100–700 Torr range.

A broad range of plasma display colors can be produced using XeF-based mixtures by means of controlling the XeF(C) vibrational temperature through mixture modification. This unique behavior is a consequence of the characteristically broadband emission of the XeF(C) excimer, in contrast to the narrow line radiation typical of simple mixtures of inert gases such as the widely used Ne-Penning mixture.

Figure 4:
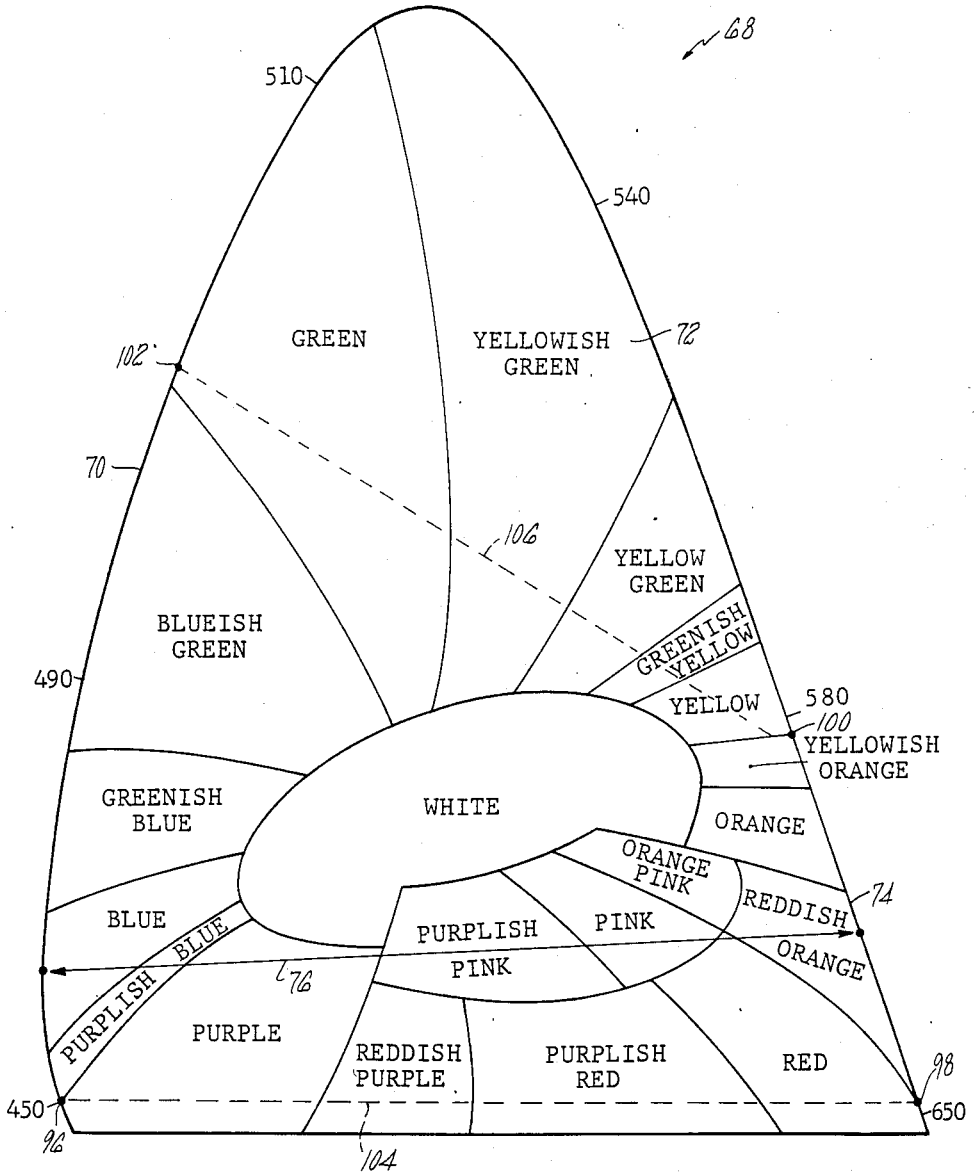
FIG. 4 is an adaptation of the International Chromaticity diagram showing the relationship of display colors observed to visible emission wavelengths characterized by the excimer optical display of FIG. 1.

In addition to the ability to produce monochrome displays having various colors dependent on gas mixture, the excimer optical display provided according to the present invention can also be used to produce the equivalent of a multicolor or full color display. Presented in FIG. 4 is an adaptation 68 of the International Chromaticity diagram specified in 1931 by the Commission International de l'Eclairge (CIE). As is well known the International Chromaticity diagram characterizes colors conveniently in two dimensions. The perimeter 70 defines pure wavelengths or colors while the regions within the area of the diagram, of which region 72 is an example, define generally accepted shades of color as perceived by the eye. The numerals on perimeter 70 correspond to wavelength in nanometers.

When two colors are mixed additively the color representing the mixture lies on a straight line connecting the two colors. For example, the radiation producing the characteristic orange color of conventional Ne-Penning display mixtures occurs for wavelengths between 582 nm and 640 nm toward the red region of the diagram. Thus, Ne-based displays can only exhibit colors ranging from 582 nm (yellow) to 640 nm (red) along line 74 in FIG. 5. Hence the characteristic color is actually a reddish orange and little variation from this color is possible.

However the excimer optical display provided according to the present invention exhibits colors ranging from pink to pink-white to blue-white to blue depending on gas mixture as described hereinabove with respect to FIG. 3. The colors thereof lie approximately on line 76 connecting the Ne red region of the diagram at a wavelength of about 600 nm and the XeF blue region at a wavelength centered at 475 nm. The color actually perceived by the eye, that is the exact color region of the chromaticity diagram, depends on the proportional amount of red or blue produced by the specific gas mixture.

Figure 5:
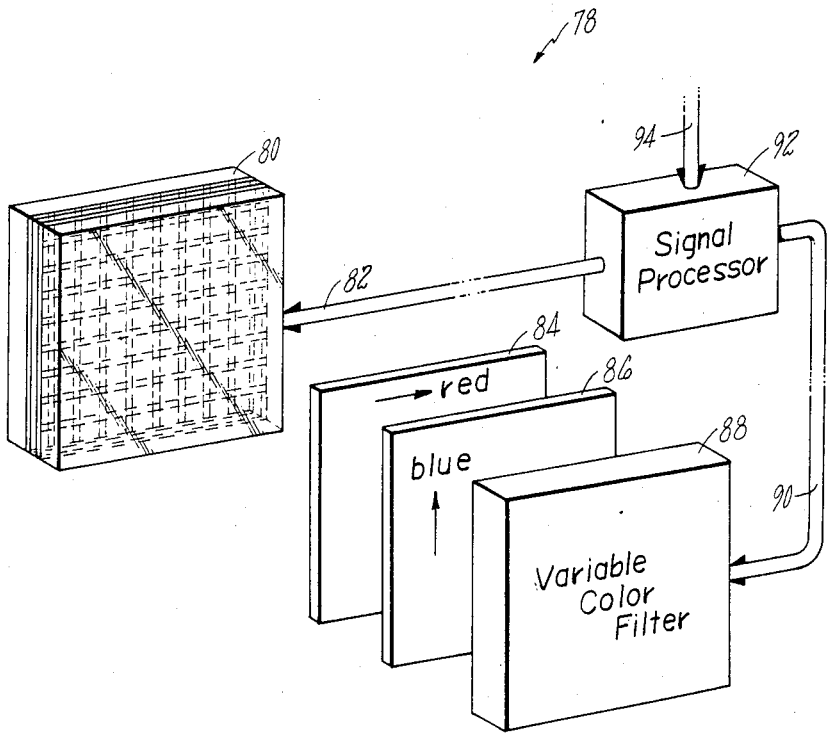
FIG. 5 is an exploded schematic diagram of a full color XeF excimer optical display provided according to the present invention.

FIG. 5 is an exploded schematic illustration of a full color XeF excimer optical display 78 provided by the present invention. As is well known in the prior art, a full color display can be constructed with a two color luminescent source having a large separation between wavelengths by first separating the emitted light into its two primary components and then recombining the light by conventional electronic means in desired proportions to display information in a selectable color format.

The full color XeF excimer optical display 78 comprises optical display 80 that is responsive to synchronization signals received on lines 82. The optical display is similar to that described hereinabove with respect to FIG. 1 and includes an enclosure having electrode arrays fabricated on at least one opposing major surface of an interior cavity that has a gas mixture therein. Also included are polarization filters 84 and 86 which are positioned to intercept the light from the optical display. For example, the polarization filters 84 and 86 correspond to red and blue colors respectively. In the best mode embodiment the orthogonally polarized red and blue light is recombined in a desired proportion using a variable color filter 88 which is electronically synchronized with display 80 by signals received on lines 90, thereby producing a full color visual image. The polarization filters, including the variable color filter are conventional, with the variable color filter typically comprised of a liquid crystal switch or shutter, such as a Tektronix No. 808-0004-00, which alternately transmits red and blue light rotating the polarization vectors of each color into the line of sight of a linear polarizer. The eye then integrates the sequentially transmitted primary colors into a wide range of desired colors depending on the relative intensities of the transmitted red and blue primaries.

Signal processor 92 is responsive to external command signals on lines 94. In response thereto, the signal processor will provide synchronization signals to the optical display creating a plasma discharge in selected discharge sites and further synchronizes the color of the light transmitted by the variable color filter by providing synchronization signals thereto. The signal processor is of a type well known in the art and in the best mode embodiment comprises a display controller having a display list processor and a bit map. Other passive or active filtration and/or polarization techniques that are known to those skilled in the art can be incorporated internally or externally to the display and can also be used to produce a multicolor display using the present invention by either AC or DC electric discharge techniques.

Referring again to FIG. 4, line 76 connects the mid-range of the Ne red emission and the mid-range of the broadband XeF excimer emission. However Ne emission extends from 580 nm to 640 nm while the XeF C→A emission extends from 400 nm to 600 nm. Therefore, any color including white in the area defined by the points 96, 98, 100, 102 and bounded by the perimeter and lines 104 and 106 of FIG. 4 can be produced enabling the full color XeF excimer optical display of FIG. 5 to display information in a full selectable color format.

In addition to the optical properties described hereinabove, the electrical characteristics of gas discharge optical displays are also of importance. In AC plasma panel displays, for example, the voltage difference between discharge ignition and extinguishment is of particular importance. Known in the prior art as the voltage margin or memory margin, this voltage difference is essential for the storage of information with an AC plasma panel display. The magnitude of the voltage margin depends in a very complicated way on the interactive properties of an optical display's interior surface and gas mixture. Often the voltage margin is too small, varies with experimental conditions and/or is sensitive to the plasma panel's fabrication methods. For these reasons gas mixtures that exhibit a relatively large voltage margin are highly favorable.

The conventional Ne Penning mixture exhibits a voltage margin that is usually between 10 and 20 volts, but depends both on pressure and discharge excitation frequency. However the XeF excimer mixtures described hereinabove exhibit voltage margins of between 50 and 150 volts. Moreover, for any specific excimer mixture the voltage margins are relatively insensitive to variations in either total pressure or discharge excitation frequency. Such electrical properties are highly favorable for AC plasma panel operation.

In addition, excimer optical displays fabricated similar to the embodiment of FIG. 1 do not provide additional spatial isolation between individual discharge sites. Therefore, each discharge should be confined to an individual discharge site so as not to interfere with the operation of neighboring discharge sites, such property referred to as discharge or pixel spatial resolution. The XeF plasma panel displays provided according to the present invention exhibit a high degree of spatial resolution.

Similarly, although the invention has been shown and described with respect to a best mode embodiment thereof, it should be understood by those skilled in the art that various other changes, omissions and additions thereto may be made therein without departing from the spirit and scope of the invention.

We claim:

1. A full color xenon fluoride excimer optical display, comprising:

enclosure means fabricated of fluorine compatible materials having an optically transmissive portion and having an interior cavity with opposing major surfaces;

gas mixture means contained within said cavity comprising xenon, fluorine and a rare gas;

electrode array means, responsive to synchronization signals, fabricated on at least one of said opposing major surfaces forming therebetween a plurality of discharge sites, said electrode array means providing a gas discharge at said discharge sites in response to said external signals such that xenon fluoride excimer molecules are formed in an excited state, emitting visible radiation upon decay therefrom comprised substantially of two primary colors; and optical filter means for receiving said visible radiation responsive to said synchronization signals, said optical filter means dividing said visible radiation into each of said primary colors and subsequently providing selective recombination thereof in response to said synchronization signals; and electronic synchronization means responsive to an external command signal for providing said synchronization signals.

2. The full color xenon fluoride excimer optical display of claim 1, wherein said rare gas is comprised of at least one element selected from the group neon, krypton, argon and helium.

3. The full color xenon fluoride excimer optical display of claim 1, wherein said rare gas comprises neon.

4. The full color xenon fluoride excimer optical display of claim 1, wherein said rare gas comprises neon and argon.

5. The full color xenon fluoride excimer optical display of claim 1, wherein said rare gas comprises neon and krypton.

6. The full color xenon fluoride excimer optical display of claim 1, wherein said gas mixture has a xenon partial pressure substantially between 2 and 10 Torr and has a fluorine partial pressure substantially between 0.5 and 2.0 Torr.

7. The full color xenon fluoride excimer optical display of claim 1, wherein said gas mixture has a neon partial pressure less than one atmosphere and argon and krypton partial pressures less than 100 Torr.

8. An excimer optical display, comprising:

enclosure means fabricated of fluorine compatible materials having an optically transmissive portion and having an interior cavity with opposing major surfaces;

gas mixture means contained within said interior cavity comprising xenon and fluorine with a xenon partial pressure substantially between 2 and 10 Torr and a fluorine partial pressure substantially between 0.5 and 2.0 Torr and a rare gas comprised of at least one element selected from the group neon, argon, krypton and helium; and electrode array means, responsive to external command Signals, fabricated on at least one of said opposing major surfaces forming therebetween a plurality of discharge sites, said electrode array means providing a gas discharge at said discharge sites in response to said external command signals such that xenon fluoride excimer molecules are formed in an excited state, emitting visible radiation upon decay therefrom.

9. An excimer optical display, comprising:

enclosure means fabricated of fluorine compatible materials having an optically transmissive portion and having an interior cavity with opposing major surfaces;

gas mixture means contained within said interior cavity comprising xenon, fluorine and a rare gas comprised of at least one element selected from the group neon, argon, krypton and helium with a neon partial pressure less than one atmosphere and an argon and krypton partial pressure less than 100 Torr electrode array means, responsive to external command signals, fabricated on at least one of said opposing major surfaces forming therebetween a plurality of discharge sites, said electrode array means providing a gas discharge at said discharge sites in response to said external command signals such that xenon fluoride excimer molecules are formed in an excited state, emitting visible radiation upon decay therefrom.

10. An AC XeF excimer optical plasma panel display, comprising:

enclosure means fabricated of fluorine compatible materials, having an optically transmissive portion and having an interior cavity with opposing major surfaces;

gas mixture means contained within said interior cavity comprising xenon and fluorine with a xenon partial pressure substantially between 2 and 10 Torr and has a fluorine partial pressure substantially between 0.5 and 2.0 Torr and a rare gas; and electrode array means, responsive to external AC command signals, fabricated on at least one of said opposing major surfaces forming therebetween a plurality of discharge sites, said electrode array means providing a gas discharge having a voltage margin at said discharge sites in response to said external AC command signals such that xenon fluoride excimer molecules are formed in an excited state, emitting visible radiation upon decay therefrom.

11. An AC XeF excimer optical plasma panel display comprising:

enclosure means fabricated of fluorine compatible materials, having an optically transmissive portion and having an interior cavity with opposing major surfaces;

gas mixture means contained within said interior cavity comprising xenon, fluorine and a rare gas mixture having a neon partial pressure less than one atmosphere and an argon and krypton partial pressure less than 100 Torr; and electrode array means, respons to external AC command signals fabricated on at least one of said opposing major surfaces forming therebetween a plurality of discharge sites, said electrode array means providing a gas discharge having a voltage margin at said discharge sites in response to said external AC command signals such that xenon fluoride excimer molecules are formed in an excited state, emitting visible radiation upon decay therefrom.

* * * * *